United States Patent [19]

Emory et al.

[11] Patent Number: 4,591,099

[45] Date of Patent: May 27, 1986

[54] NOZZLE TO PROVIDE FAN-SHAPED SPRAY PATTERN

[75] Inventors: Lyle J. Emory, Darien; Courtney J. Jones, Warrenville, both of Ill.

[73] Assignee: Spraying Systems Co., Wheaton, Ill.

[21] Appl. No.: 549,240

[22] Filed: Nov. 7, 1983

[51] Int. Cl.[4] ..... B05B 7/04

[52] U.S. Cl. ..... 239/419; 239/427; 239/434; 239/596

[58] Field of Search ..... 239/434, 419, 427, 568, 239/432, 596, 597, 601

[56] References Cited

U.S. PATENT DOCUMENTS

| | | | |
|---|---|---|---|
| 877,178 | 6/1907 | Donovan | 239/432 |
| 1,092,674 | 4/1914 | Tinkham | 239/597 X |
| 1,197,600 | 10/1915 | Brown | 239/427 |
| 1,526,065 | 2/1925 | Herstrom | 239/427 |
| 3,251,556 | 5/1966 | Burnham | 239/432 X |
| 3,858,812 | 1/1975 | Williams et al. | 239/601 X |
| 3,927,162 | 12/1975 | Stalter | 239/597 X |
| 4,349,156 | 9/1982 | Haruch et al. | 239/432 |

*Primary Examiner*—Joseph F. Peters, Jr.
*Assistant Examiner*—Kevin Patrick Weldon
*Attorney, Agent, or Firm*—Leydig, Voit & Mayer, Ltd.

[57] ABSTRACT

An improved spray nozzle assembly particularly adopted for use in continuous casting apparatus and the like utilizing an atomized mixture of pressurized water and air as the cooling medium. The nozzle assembly is adapted to be interposed between the rolls of the casting apparatus and to deliver a cooling spray in the form of a fine mist distributed uniformly over a predetermined area of the ingot or slab. The assembly includes a specially formed mixing nozzle and discharging nozzle tip having turbulence generating shoulders, a transverse mixing chamber, and specially formed discharge orifice controlling the shape of the spray pattern and the uniformity of coolant distribution within that pattern.

20 Claims, 8 Drawing Figures

NOZZLE TO PROVIDE FAN-SHAPED SPRAY PATTERN

BACKGROUND OF THE INVENTION

1. Field of the Invention

The present invention relates to spraying devices in general and, more specifically, to an improved spray nozzle assembly which imparts a fan shaped spray pattern and finds particular but not exclusive utility in apparatus for the continuous casting of steel slabs, ingots, billets, or the like. In such apparatus, the casting is conventionally formed in a vertically oriented mold and then withdrawn through a series of closely spaced support rollers where its direction is changed from vertical to horizontal. The support rollers have interspersed cooling devices which apply a coolant spray, usually water, onto the casting for cooling and further solidification thereof. In spray systems of the type known heretofore, problems have arisen because of uneven distribution of the coolant, resulting in non-uniform cooling of the casting. Thus when coolant is applied in excessive amounts on some areas of the casting and sparse amounts, or none, on adjacent areas, cracks may occur in the casting with consequent loss of product.

2. Description of the Prior Art

In hydraulic spray systems of the type previously known, excessive amounts of liquid tend to accumulate in pockets between the rollers and the ingot, creating cool spots which adversely affect the surface of the casting. Such hydraulic nozzles have not demonstrated the ability to provide a consistently uniform spray pattern.

While air-assisted nozzles are available which permit the distribution of relatively fine sprays and consume lesser amounts of water than the hydraulic nozzles, the air-assisted nozzles have generally suffered from the drawback of non-uniform distribution. Larger droplets tend to proceed centrally through the nozzle while finer droplets are dispersed laterally. As a result, greater concentrations of coolant are dispensed axially of the nozzle then at the laterally spaced sides of the spray pattern.

The following prior U.S. patents disclose various forms of coolant spray systems used for cooling the products formed in continuous casting apparatus: U.S. Pat. No. 4,256,168—Hein et al.; U.S. Pat. No. 4,211,272—Schrewe et al.; and U.S. Pat. No. 4,136,527—Kading. The following prior U.S. patent discloses an atomizing spray nozzle over which applicants' present invention represents a substantial improvement: U.S. Pat. No. 4,349,156—Haruch et al.

SUMMARY OF THE INVENTION

One object of the invention is to provide a spray nozzle assembly of the character set forth above which will produce a high degree of atomization of the coolant and uniform distribution of coolant spray throughout the predetermined spray pattern.

Another object of the present invention is to provide a coolant spray nozzle assembly for continuous casting apparatus and the like which is adapted to confine the spray to an elongated and relatively narrow uniform spray pattern between a pair of support rollers.

A further object of the invention is to provide a spray nozzle assembly of the foregoing type which permits efficient, relatively uniform cooling of continuous cast slabs, ingots, and billets with significant savings of cooling water.

Still another object is to provide a spray nozzle assembly of the above type having a mixing and discharging nozzle tip which is adapted to receive the high velocity stream of coolant droplets and air from a preliminary coolant atomizing head, to enhance the turbulence and mixing of the stream, and to discharge same through an orifice in the form of a fine mist uniformly distributed throughout a spray pattern of predetermined shape.

The foregoing is accomplished by the use of an air-hydraulic upper unit serving as a preliminary coolant atomizing source; a relatively long tubular barrel into which the preliminary atomizing source discharges at high velocity giving the atomized coolant large momentum; and a combined mixing and discharging nozzle tip fixed to and communicating with the long tubular barrel. The mixing and discharging nozzle tip is fashioned with turbulence enhancing means, a transverse mixing chamber, and a discharge orifice contoured to facilitate an effective spray pattern and an even distribution of atomized coolant droplets throughout the spray pattern.

DETAILED DESCRIPTION OF THE INVENTION

Figure 1:
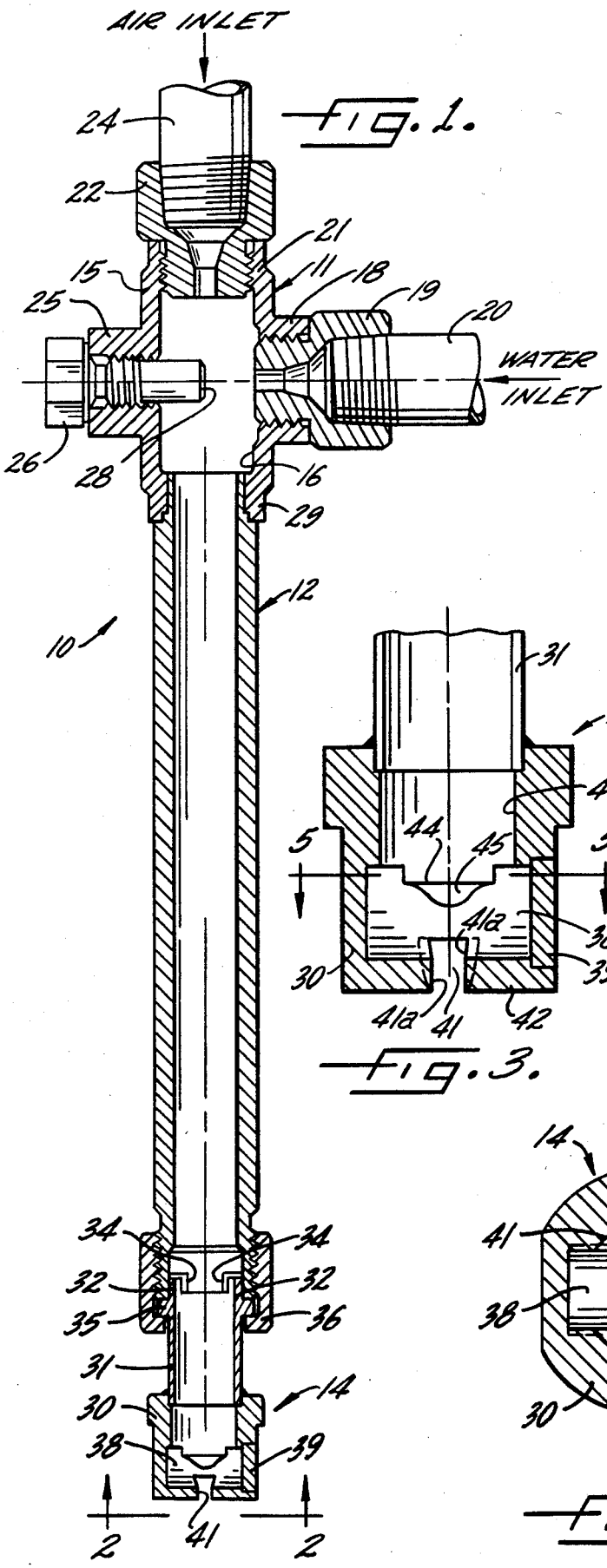
FIG. 1 is a longitudinal sectional view through an illustrative spray nozzle assembly exemplifying the present invention.

Referring more specifically to FIG. 1, the invention is there exemplified in an illustrative spray nozzle assembly 10. The latter comprises a preliminary coolant atomizing head 11, an elongate tubular barrel 12 connected at its upper end to the head 11, and a mixing and discharging nozzle tip 14 connected to the lower end of the barrel 12.

The atomizing head 11 comprises a hollow body 15 having an expansion chamber 16 extending axially thereof. The body has a radially extending threaded hub 18 which mounts an orifice fitting 19 connected to cooling water or other fluid inlet line 20. The body 15 also includes an axially extending threaded hub 21 which mounts an orifice fitting 22 connected to air inlet line 24. The body further includes another radial threaded hub 25 which threadedly receives a screw 26. The inner end portion of the latter is unthreaded and defines a circular impingement face 28 disposed in spaced apart opposed relation to the inner end of the water inlet orifice 19. The screw 26 is fixed so as to locate the impingement face 28 approximately on the longitudinal axis of the body 15 so that it will be swept directly by the jet of pressurized air entering through the air inlet orifice 22. The end of the body remote from the air inlet has a circular hub 29 which is rigidly connected to one end of the tubular barrel 12.

The shape of the spray pattern and the distribution of atomized coolant droplets within the pattern are determined by the mixing and discharging nozzle tip 14 (FIGS. 1–6). The latter comprises an orifice member 30 supported on a hollow stem 31 fixed to the barrel 12. To facilitate ready changing of nozzle tip 14, the stem 31 is formed in the present instance with a pair of diametrically opposed locating lugs 32 which register with corresponding recesses 34 in the inner bore of the barrel. The nozzle tip is retained in place by means of a peripheral flange 35 adapted to be clamped against the end of the barrel by clamp nut 36.

In accordance with the present invention, the high velocity stream of air and atomized fluid droplets from the head 11 and barrel 12 is injected into the nozzle tip 14 where it is subjected to increased turbulence and further mixing. The stream is then discharged at high velocity from the nozzle tip as a fine mist in a predetermined, generally fan shaped spray pattern with the droplets uniformly distributed throughout the pattern. This is accomplished by the interaction of the internal structural features of the nozzle tip as described below.

Referring more specifically to FIGS. 2–6, it will be noted that the orifice member 30 of the nozzle tip is formed with a transverse, mixing chamber 38 adjacent its outer end portion, which in this case is cylindrical in shape. The chamber 38 in this instance extends diametrically across the orifice member 30 and in perpendicular relation to the longitudinal axis of the latter. For convenience in manufacture, the chamber 38 may be formed by drilling or otherwise forming a transverse hole in the head 30 and then sealing the opening in the head sidewall by means of a fixed plug 39. The hollow stem 31 of the nozzle tip communicates with the mixing chamber 38 via a central longitudinal bore 40 having a diameter slightly larger than the inner diameter of the stem 31. The mixing chamber 38 discharges fluid in a fine spray via discharge aperture 41 situated in the outside end face 42 of the orifice member 30.

In order to enhance mixing of the high velocity stream of atomized droplets and air entering the nozzle tip 14, the central bore 40 is extended axially so as to intersect the top portion of the mixing chamber 38 well above its center. The intersecting plane may penetrate the cylindrical chamber 38 well above its axis and in this case may be situated inside the chamber a distance of approximately one-third to one-half the radius of the latter. As shown more fully in FIGS. 3–5, this relationship defines a pair of diametrically opposed segmental shoulders or abutments 44 in a plane perpendicular to the axis of the central bore 40. The shoulders 44 have a pair of opposed arcuate notches 45 on their inner faces defined by an axial bore 46 which extends between the lower end of the central bore 40 and the discharge aperture 41. The bore 46 in this case has substantially the same diameter as the transverse mixing chamber 38. The shoulders 44 are situated on lands 47 which straddle the mixing chamber.

Figure 2:
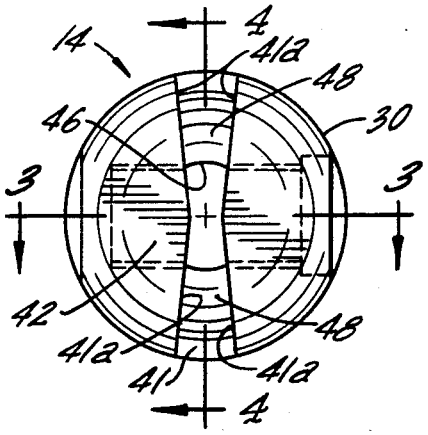
FIG. 2 is an enlarged discharge end view showing the tip of the illustrative spray nozzle shown in FIG. 1.
Figure 3:
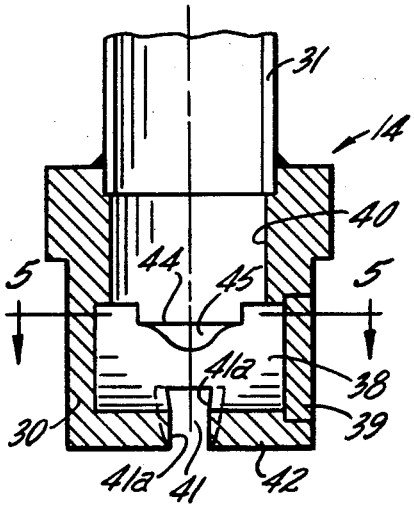
FIGS. 3 and 4 are enlarged, fragmentary longitudinal sectional views through the mixing and discharging nozzle tip, taken in the planes of the lines 3—3 and 4—4, respectively in FIG. 2.
Figure 4:
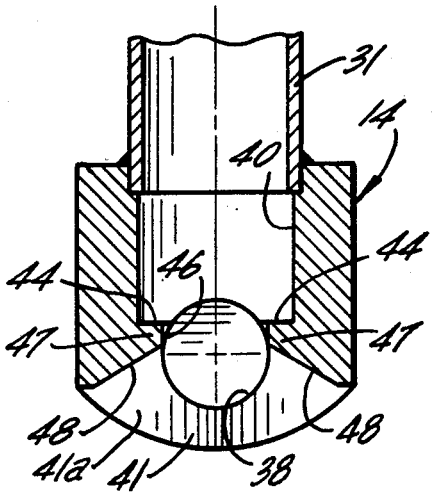
Figure 5:
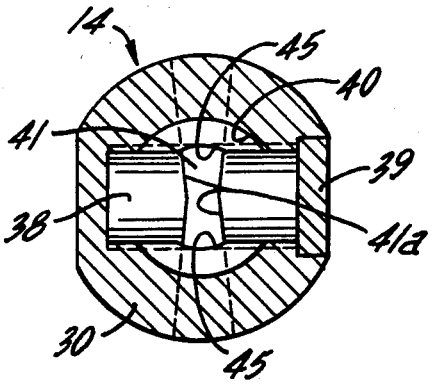
FIG. 5 is a horizontal sectional view taken through the nozzle tip in the plane of the line 5—5 in FIG. 3.

Turning next to the discharge orifice 41, as indicated earlier herein, the latter communicates between the mixing chamber 38 and the exterior of nozzle tip 14. As shown in FIGS. 2, 4 and 5, the orifice 41 extends diametrically across the entire outer end face of the nozzle tip 14. The orifice 41 in this instance is narrowest along the longitudinal axis of the nozzle tip and widest at the outer periphery thereof. Its sides are undercut so that it has a slight taper narrowing down as the outer peripheral surface of the tip is approached. The outer end portions of the lands 47 have chamfered faces 48 which define the throat of the discharge orifice. The faces 48 together subtend an angle, which in the illustrated embodiment is shown as approximately 120°, to facilitate formation of the fan shaped discharge. The end face 42 preferably has an outwardly bowed, arcuate shape, when viewed in a plane parallel to aperture 41, such that faces **41*a*** of the nozzle tip, which define the aperture, tend to enhance the uniformity of discharge from the nozzle.

Figure 6:
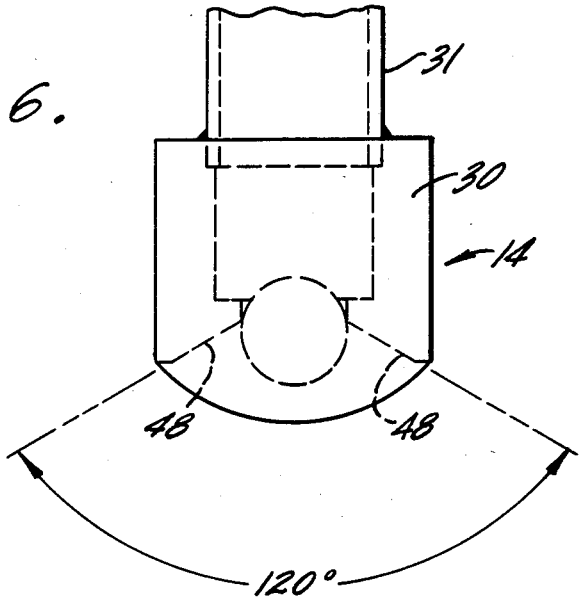
FIG. 6 is an enlarged fragmentary elevational view of the mixing and discharging nozzle illustrating the angle of the spray pattern in the plane of the discharge orifice.

In operation of the nozzle assembly, the atomizing head 11 generates a high velocity stream of air and atomized fluid droplets which is directed through the barrel 12 to the nozzle tip 14. The stream proceeds along the hollow stem 31, the central bore 40, and into the transverse mixing chamber 38. Diametrically opposed outer portions of the stream are accosted and deflected inwardly by the opposed segmental shoulders 44 at the downstream end of the bore 40. This produces further atomizing of droplets and additional turbulence in the moving stream as it enters the mixing chamber 38. The latter, having a length somewhat longer than the width of the entry stream, facilitates further mixing of the atomized droplets and moving air stream. The mixture of finally atomized fluid and air is then discharged from the orifice 41 in a predetermined fan shaped spray pattern of relatively narrow width having the fluid distributed uniformly as a fine mist throughout the pattern. As indicated in FIG. 6, in the illustrated embodiment, the spray pattern in the general plane of the discharge orifice subtends an angle of about 120°. In such embodiment, it has been found that at a distance of 10 inches from the nozzle tip, the spray pattern may have a length of approximately 28 inches and a width of approximately 2 inches.

Figure 7:
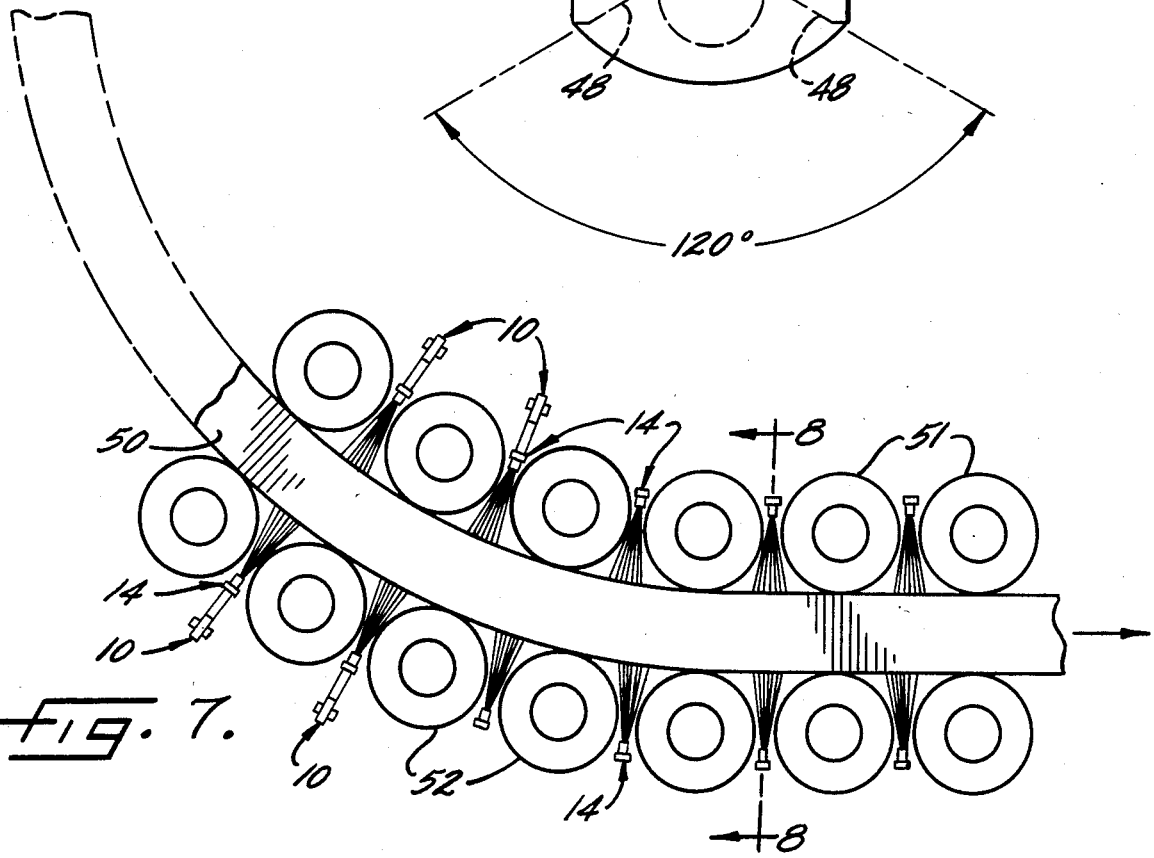
FIG. 7 is a side elevational view of a series of support rollers in a continuous casting apparatus with a cast steel slab passing therethrough and illustrating the arrangement of the spray nozzles in the casting apparatus.
Figure 8:
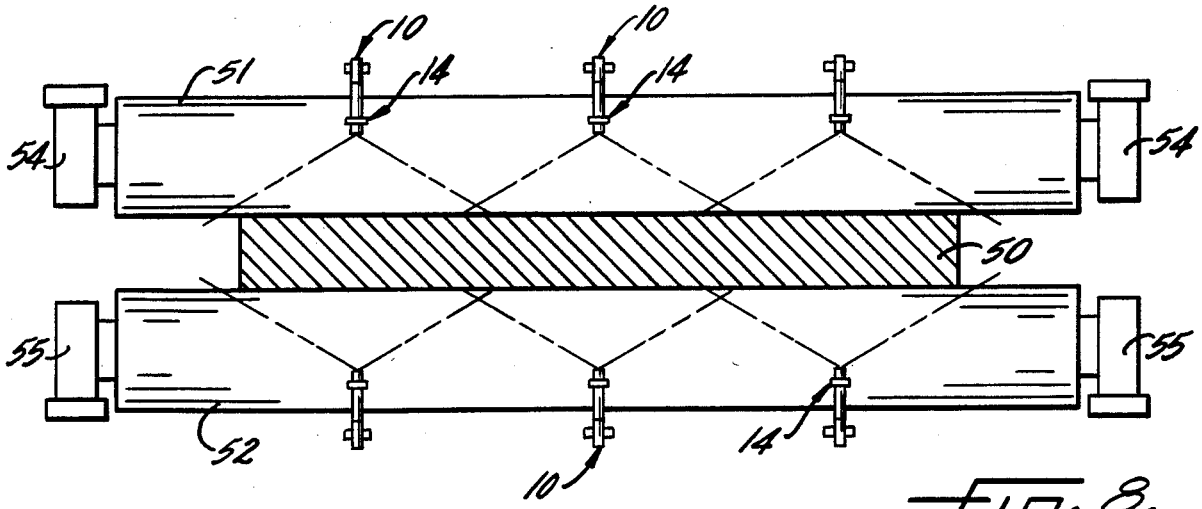
FIG. 8 is a transverse sectional view taken in the plane of the line 8—8 in FIG. 7 and illustrating the transverse arrangement of the spray nozzles above and below the cast slab.

As noted earlier herein, the improved jet spray nozzle assembly 10 finds particular utility in apparatus for the continuous casting of steel slabs, ingots, billets, and the like. Referring more specifically to FIGS. 7 and 8, there is shown a steel slab 50 which has just emerged from a continuous caster and is making the transition from vertical to horizontal orientation. This is done by means of a parallel sets of support rollers 51, 52 bearing respectively on opposite sides of the ingot. In this case, the ingot happens to be approximately 80 inches in width and 10 inches thick with its central interior portion still molten.

The upper support rollers 51 are journaled in bearings 54 mounted on an upper frame (not shown). Similarly, the lower support rollers 52 are journaled in bearings 55 mounted on a lower frame (not shown), the frames being adjustable to accommodate different sized ingots. Each set of support rollers in this instance happens to have adjacent rollers spaced with their peripheries about 2 inches apart.

As shown in FIGS. 7 and 8, a plurality of jet spray nozzle assemblies 10 are inserted in the space between each pair of support rollers in each set. As indicated in FIG. 8, three jet spray nozzle assemblies 10 are located between each pair of upper rollers and three such assemblies are located between each pair of lower rollers. For purposes of simplifying illustration, the complete jet spray nozzle assembly 10 has not been shown with every nozzle tip 14. It should be understood, however, that each nozzle tip 14 which appears in FIGS. 7 and 8 is intended to represent a complete spray nozzle assembly 10. The spray nozzle assemblies are oriented so that their fan shaped spray patterns extend parallel to the axes of the rollers. In this case, with the nozzle tip 14 spaced about 10 inches from the surface of the ingot, the spray pattern projected on the ingot by each nozzle tip will be on the order of 28 inches transversely of the ingot by 2 inches longitudinally of the ingot. The spacing of the spray nozzle assemblies is such that their fan shaped patterns overlap slightly at the ends to be certain that the face of the moving ingot is cooled uniformly.

The nozzle assemblies shown in FIGS. 7 and 8 may be supported between the rollers in any suitable manner and the support means may include provision for adjusting their positions and appropriate piping for supplying the necessary pressurized air and water to enable them to cool the ingot.

From the foregoing, it can be seen that the spray nozzle assembly of the present invention is adapted to produce a high degree of atomization of coolant and the uniform distribution of the coolant in a well defined elongated spray pattern. Hence, such nozzle assembly has been found to be highly efficient in effecting relatively uniform cooling of continuous cast slabs and the like, with significant savings in cooling water requirements.

We claim as our invention:

1. A spray nozzle assembly for directing fluid in a long and relatively narrow fan shaped pattern comprising, in combination:

(a) a mixing and discharge nozzle tip;

(b) said nozzle tip having means for permitting the coupling thereof to a fluid supply line;

(c) means defining a central longitudinally extending bore into said mixing and discharge nozzle tip;

(d) means defining a transverse mixing chamber in said mixing and discharge nozzle tip intersected by said central longitudinal bore;

(e) a pair of segmental diametrically opposed shoulders formed in said central longitudinal bore in parallel relation to the axis of said transverse mixing chamber and disposed at the plane of intersection of said central bore with said mixing chamber for imparting turbulence to the flow entering said mixing chamber; and (f) means defining a discharge orifice communicating with said mixing chamber in a plane transverse to the axis of said mixing chamber and transverse to said segmental shoulders.

2. The spray nozzle assembly of claim 1 in which said transverse mixing chamber is generally cylindrical in shape.

3. The spray nozzle assembly of claim 1 wherein said shoulders have opposed arcuate notches.

4. The spray nozzle assembly of claim 2 in which said plane of intersection between said central longitudinal bore and said transverse mixing chamber is disposed above the axis of said mixing chamber.

5. The spray nozzle assembly of claim 1 in which said discharge orifice is narrowest at the center and tapers to maximum width at its outer ends.

6. The spray nozzle assembly of claim 5 in which the sides of said discharge orifice are undercut.

7. The spray nozzle assembly of claim 1 in which said shoulders are disposed on lands that straddle said mixing chamber, and said lands each are formed with an outwardly inclined chamfered face which define a throat of said discharge orifice.

8. The spray nozzle assembly of claim 7 in which said chamfered faces subtend an angle of approximately 120 degrees.

9. The spray nozzle assembly of claim 1 including an atomizing head adapted for receiving separate transversely directed streams of liquid and air and for delivering a high velocity stream of atomized droplets of fluid mixed with air, and means coupling said atomizing head to said mixing and discharging nozzle tip.

10. The spray nozzle assembly of claim 9 in which said coupling means includes an elongated tubular barrel connected between said atomizing head and said mixing chamber.

11. The spray nozzle assembly of claim 9 in which said atomizing head includes an air inlet for directing air towards said discharge orifice along the axis of said bore, and a liquid inlet for directing liquid into said head at a substantial angle to the axis of said bore for atomizing said liquid before delivery to said mixing and discharging nozzle tip.

12. The spray nozzle assembly of claim 11 in which said atomizing head includes means defining an impingement face located approximately on the longitudinal axis of said bore and against which liquid entering said atomizing head from said liquid inlet impinges.

13. A spray nozzle assembly for directing fluid in a long and relatively narrow fan shaped pattern comprising, in combination:

(a) a mixing and discharging nozzle tip;

(b) a preliminary atomizing head;

(c) means defining a central longitudinally extending bore communicating from said atomizing head and extending into said nozzle tip;

(d) said atomizing head having an air inlet for directing air toward said nozzle tip along the axis of said central bore and a liquid inlet for directing liquid into said atomizing head at a substantial angle to the axis of said central bore;

(e) means defining a transverse mixing chamber in said nozzle tip intersected by said central longitudinal bore; said transverse mixing chamber extending a length greater than the diameter of said central bore; and (f) means defining a discharge orifice communicating with said transverse mixing chamber symetrically disposed relative to the axis of said central bore and extending across an end of said nozzle tip in a plane transverse to the axis of said mixing chamber, whereby fluid passing through said bore and mixing chamber discharges from said orifice in a long and narrow fan shaped spray pattern of relatively uniformly sized fluid droplets.

14. The spray nozzle assembly of claim 13 in which said mixing and discharging nozzle tip includes a pair of opposed shoulders defined in said longitudinal bore at its plane of intersection with said mixing chamber, said opposed shoulders being disposed in transverse relation to the plane of said discharge orifice.

15. The spray nozzle of claim 13 in which said mixing chamber is generally cylindrical in shape.

16. The spray nozzle assembly of claim 15 in which said plane of intersection between said central longitudinal bore and said transverse mixing chamber is situated above the axis of said mixing chamber.

17. A spray nozzle assembly comprising, in combination:

(a) a preliminary fluid atomizing head adapted to deliver a high velocity stream of fluid droplets mixed with air;

(b) a mixing and discharging nozzle tip connected to said preliminary fluid atomizing head and adapted to receive said stream from the latter;

(c) means defining a central longitudinal bore in said mixing and discharging tip;

(d) means defining a transverse mixing chamber in said mixing and discharging nozzle tip intersected by said central longitudinal bore;

(e) a pair of segmental diametrically opposed shoulders formed in said central longitudinal bore in parallel relation to the axis of said transverse mixing chamber and disposed at the plane of intersection of said central bore with said mixing chamber for imparting turbulence to the flow entering said mixing chamber; and (f) means defining a discharge orifice communicating with said mixing chamber in a plane transverse to the axis of said mixing chamber and transverse to said segmental shoulders.

18. The spray nozzle assembly of claim 17 in which said shoulders are formed with opposed arcuate notches.

19. The spray nozzle assembly of claim 18 in which said plane of intersection between said central longitudinal bore and said transverse mixing chamber is situated above the axis of said mixing chamber.

20. The spray nozzle assembly of claim 18 in which said shoulders are disposed on lands that straddle said mixing chamber, and said lands each are formed with an outwardly inclined chamfered face which define a throat of said discharge orifice.

* * * * *